US006496211B2

(12) United States Patent
Katsuma

(10) Patent No.: US 6,496,211 B2
(45) Date of Patent: Dec. 17, 2002

(54) THERMAL PRINTER AND THERMAL PRINTING METHOD

(75) Inventor: Nobuo Katsuma, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/987,187

(22) Filed: Nov. 13, 2001

(65) Prior Publication Data

US 2002/0057326 A1 May 16, 2002

(30) Foreign Application Priority Data

Nov. 13, 2000 (JP) ..... 2000-345680

(51) Int. Cl.[7] ..... B41J 2/355; B41J 2/36
(52) U.S. Cl. ..... 347/188; 347/211
(58) Field of Search ..... 347/211; 400/633, 400/279

(56) References Cited

U.S. PATENT DOCUMENTS 4,738,553 A * 4/1988 Uemura et al. ..... 347/181
6,305,856 B1 * 10/2001 Miyazaki ..... 400/279

FOREIGN PATENT DOCUMENTS

JP 5-142916 * 6/1993 ..... B41J/2/525
JP 9-272217 10/1997

* cited by examiner

*Primary Examiner*—Huan Tran
(74) *Attorney, Agent, or Firm*—Birch, Stewart, Kolasch & Birch, LLP

(57) ABSTRACT

A thermal printer has a thermal head including plural heating elements. The heating elements are arranged in an array in a main scan direction, are driven according to image data, for recording an image to thermosensitive recording paper moved in a sub scan direction. The recording paper has a size smaller in the main scan direction than the thermal head. The thermal printer includes two arrays of photo receptor elements for detecting two lateral edges of the recording paper, to determine effective heating elements in contact with the recording paper among the heating elements. A data correcting unit effects a correcting process to part of the image data for heating elements of a first group included in the effective heating elements. The first group contacts each of the two lateral edges and a near portion near to the lateral edge with reference to the main scan direction in the recording paper.

14 Claims, 8 Drawing Sheets

THERMAL PRINTER AND THERMAL PRINTING METHOD

BACKGROUND OF THE INVENTION

1. Field of the Invention

The present invention relates to a thermal printer and thermal printing method. More particularly, the present invention relates to a thermal printer and thermal printing method in which an image can be printed with agreeable quality in a form without a margin or with a very narrow margin.

2. Description Related to the Prior Art

There is a thermal printer including a thermal head in which heating elements are arranged in an array extending in a main scan direction. Recording paper is fed in a sub scan direction perpendicular to the main scan direction, so as to drive the heating elements for thermal recording. There are plural types of the thermal printer, including a thermal transfer recording and direct thermal recording. In the thermal transfer recording, an ink sheet is squeezed between the thermal head and the recording paper and heated to transfer ink from the ink sheet to the recording paper. In the direct thermal recording, a thermosensitive type of the recording paper is used, and has thermosensitive coloring layers for developing colors in response to application of heat.

In any type of the thermal printer, it is preferable to use the full width of the recording paper for printing an image without forming margins. JP-A 9-272217 discloses the thermal printer in which the thermal head including the heating elements has a greater length than the width of the recording paper. The thermal printer is provided with an edge sensor for detecting a lateral edge of the recording paper for preventing the heating elements from overheating specifically in positions outside the lateral edge of the recording paper. Thus, heating elements included in the heating elements and disposed outside the lateral edge is forcibly kept from being driven.

However, there arises a problem in the thermal printer in that coloring density of a printed image decreases toward the lateral edge of the recording paper between portions of the recording paper. The quality of printing an image will be lower because of low fidelity in reproducing the image.

Also, the recording paper may be so disposed or so shaped that one of its lateral edge comes to intersect one of the heating elements without lying on a borderline between two heating elements. The one particular heating element causes an unwanted black streak along the lateral edge, because the coloring density rises extremely in a local manner instead of the gradual decrease in the density.

SUMMARY OF THE INVENTION

In view of the foregoing problems, an object of the present invention is to provide a thermal printer and thermal printing method in which the coloring density of a printed image is prevented from having unevenness near a lateral edge of the recording material between portions of the recording material, to raise the quality of printing an image.

In order to achieve the above and other objects and advantages of this invention, a thermal printer has a thermal head including plural heating elements, wherein the heating elements are arranged in an array in a main scan direction, are driven according to image data, for recording an image to recording material moved in a sub scan direction, the recording material having a size smaller in the main scan direction than the thermal head. The thermal printer includes a position determining unit for detecting at least one lateral edge of the recording material, to determine effective heating elements in contact with the recording material among the heating elements. A data correcting unit effects a correcting process to part of the image data for heating elements of a first group included in the effective heating elements, wherein the first group contacts the at least one lateral edge and a near portion near to the at least one lateral edge with reference to the main scan direction in the recording material.

Remaining heating elements included in the heating elements but different from the effective heating elements are supplied with non-printing data by way of the image data, and are kept from being driven.

In a preferred embodiment, the data correcting unit corrects the image data by adding predetermined additional data thereto, the additional data increasing in a heat energy level toward the lateral edge between the heating elements in the first group.

In another preferred embodiment, the first group includes P heating elements, including a first heating element in a middle of which the at least one lateral edge is positioned. Q heating elements are disposed adjacent to a train of the P heating elements. The data correcting unit substitutes non-printing data for part of the image data for the P heating elements, to keep the P heating elements from being driven. The data correcting unit further corrects part of the image data for the Q heating elements by adding predetermined additional data thereto, the additional data increasing in a heat energy level toward the lateral edge between the Q heating elements.

In a preferred embodiment, P=1.

The position determining unit has plural photo receptor elements arranged in an array in the main scan direction and at a pitch equal to or less than a pitch of the plural heating elements, for detecting at least one of first and second lateral edges of the recording material.

Furthermore, a guide member guides the first lateral edge of the recording material in the sub scan direction. A pad mechanism pushes the second lateral edge of the recording material in the main scan direction, to press the first lateral edge against the guide member. The position determining unit detects the second lateral edge.

In a further preferred embodiment, the position determining unit includes first and second arrays of photo receptor elements, disposed to extend in the main scan direction, for detecting the first and second lateral edges of the recording material.

In another preferred embodiment, the plural heating elements characteristically have small resistance according to highness of temperature, and heat is caused to dissipate from the effective heating elements more quickly than from the remaining heating elements by contact with the recording material. Furthermore, a head driver applies a predetermined voltage to the heating elements. The position determining unit further comprises a temperature measurer measures temperature of respectively the heating elements. A heating time measurer measures heating time elapsed while the temperature rises to a predetermined temperature. A determiner compares the heating time between the heating elements, and determines that heating elements of which the heating time is longer are the effective heating elements.

The temperature measurer includes a measurement resistor connected with the heating elements. A voltage detector detects a connection voltage of a connection point between the heating elements and the measurement resistor. The heating time measurer includes a comparator for comparing the connection voltage with a reference voltage. A counter is started counting in response to driving of the heating elements, and is stopped from counting in response to an output of the comparator upon coming of the connection voltage down to the reference voltage.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
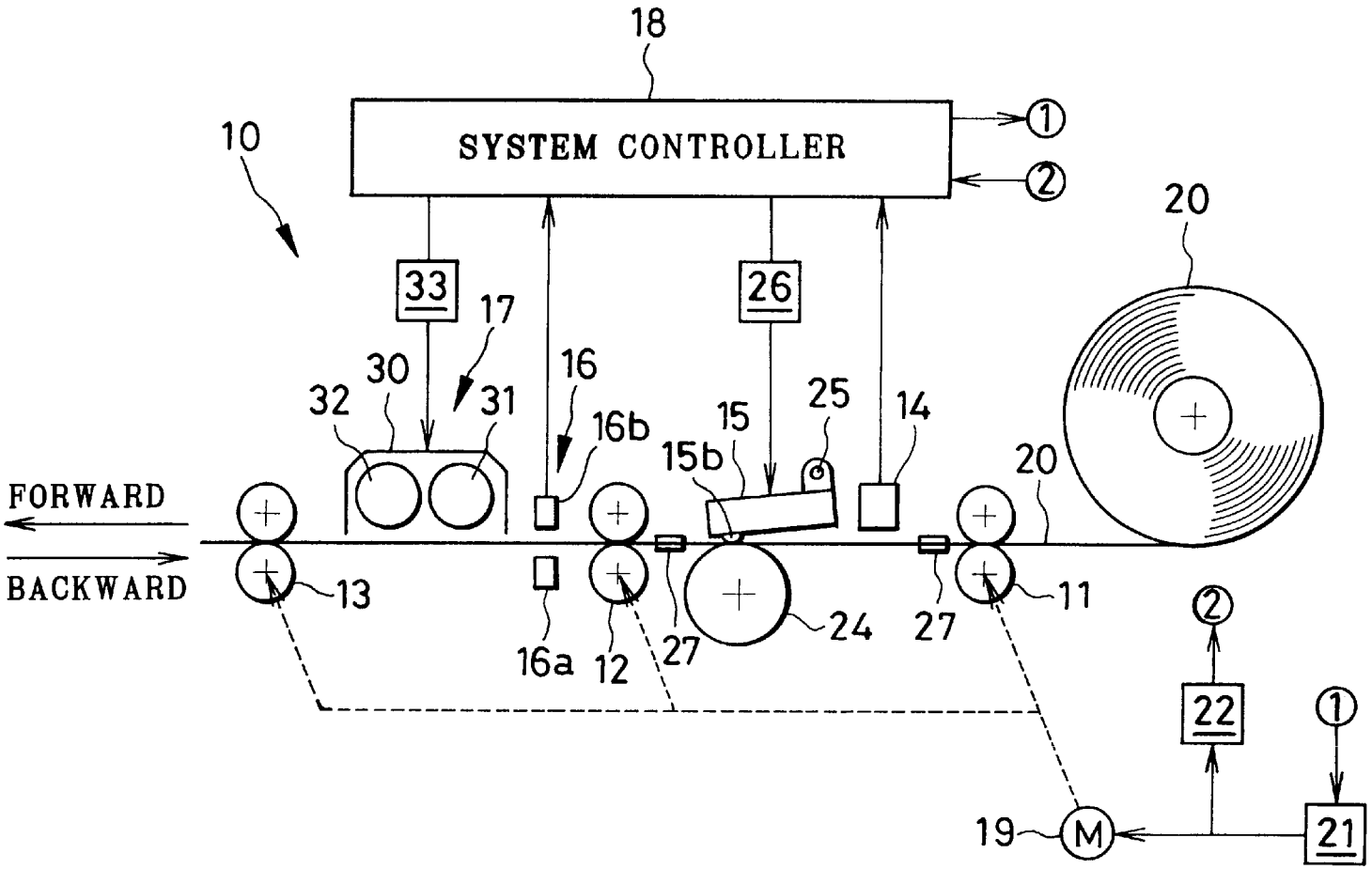
FIG. 1 is an explanatory view illustrating a color thermal printer of the invention.

In FIG. 1, a color thermal printer 10 is illustrated. The color thermal printer 10 includes first, second and third feeder rollers 11, 12 and 13, a line sensor 14 as position determining unit, a thermal head 15, a photo sensor or photo interrupter 16, an optical fixer 17, a system controller 18 and other elements. A stepping motor 19 rotates the feeder rollers 11, 12 and 13 in forward and backward directions. Color thermosensitive recording paper 20 as recording material is wound in a roll form, and moved by the feeder rollers 11–13 back and forth in the longitudinal direction. A motor driver 21 is connected between the stepping motor 19 and the system controller 18, and is caused by the system controller 18 to control rotation of the stepping motor 19.

A pulse counter 22 counts driving pulses supplied to the stepping motor 19. According to the counted number in the pulse counter 22, the system controller 18 designates a printing start position, a paper returning position and a cutting position. The pulse counter 22 counts up the driving pulses while the stepping motor 19 rotates in the forward direction, and counts down the driving pulses while the stepping motor 19 rotates in the backward direction.

The recording paper 20 includes three thermosensitive coloring layers overlaid on a support, the coloring layers including those for cyan, magenta and yellow colors. The yellow coloring layer has highest heat sensitivity, and develops yellow in response to relatively low heat energy. The cyan coloring layer has lowest heat sensitivity, and develops cyan in response to relatively high heat energy. When near ultraviolet rays having a wavelength peak at 420 nm are applied to the recording paper 20, coloring ability of the yellow coloring layer is destroyed. The magenta coloring layer develops magenta in response to heat energy in a range between the heat energy ranges for coloring the yellow and cyan coloring layers. When ultraviolet rays having a wavelength peak at 365 nm are applied to the recording paper 20, coloring ability of the magenta coloring layer is destroyed.

Figure 2:
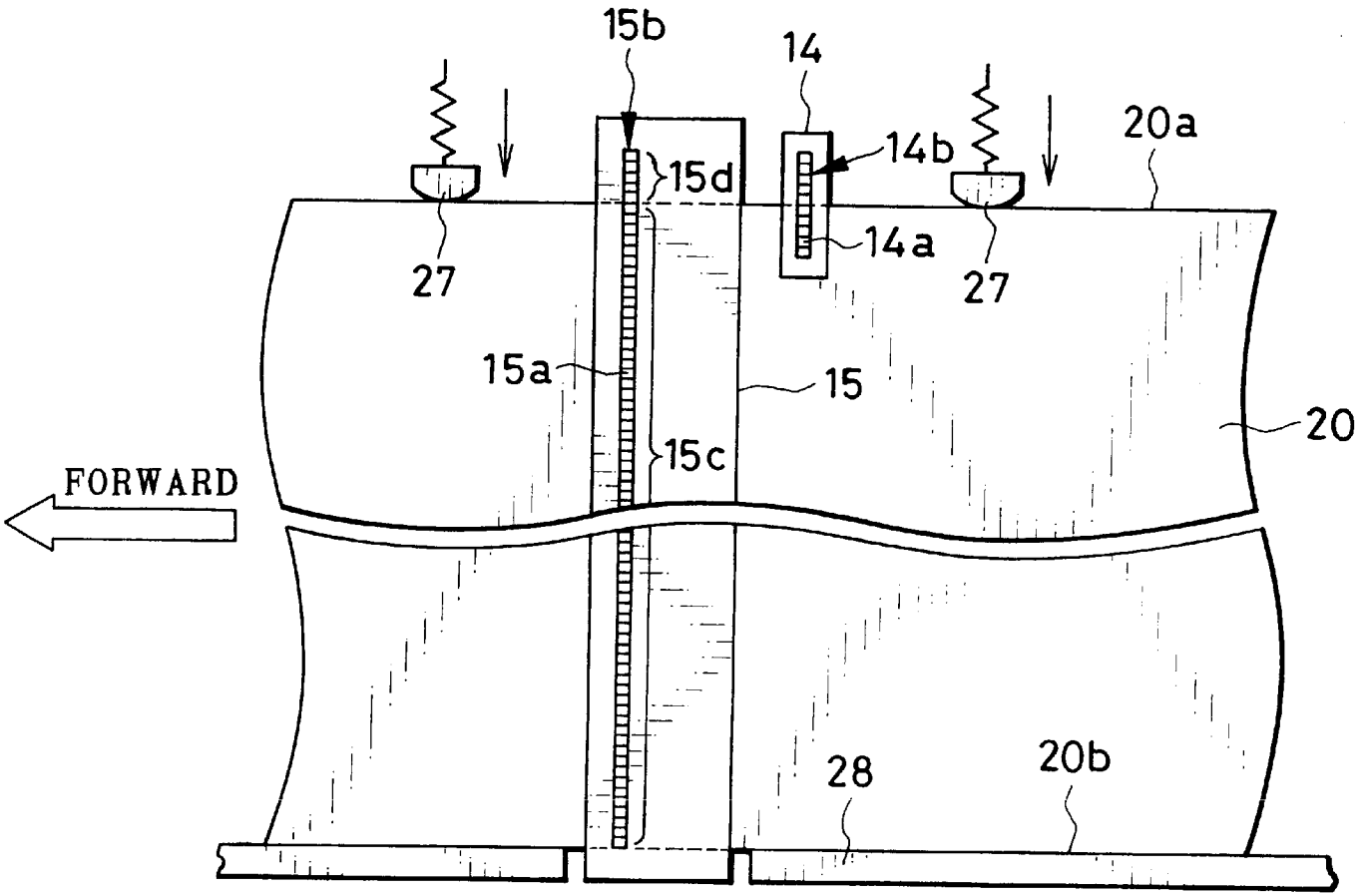
FIG. 2 is a plan, partially cutaway, illustrating a thermal head, thermosensitive recording paper and other elements in the thermal printer.

The thermal head 15 is disposed between the feeder rollers 11 and 12. In FIG. 2, the thermal head 15 includes an array 15*b* of numerous heating elements 15*a*, and extends in a main scan direction. The array 15*b* has a length sufficiently greater than a width of the recording paper, although an image is printed to the recording paper 20 in a manner with a very small margin. A lateral edge 20*b* of the recording paper 20 is set at one end of the array 15*b* because of a guide member for guiding the recording paper 20, to be described later.

In FIG. 1, a platen roller 24 is in a position in a feeding path, is opposed to the thermal head 15, for supporting the recording paper 20. A pivot 25 of the thermal head 15 keeps the thermal head 15 movable pivotally thereabout. The thermal head 15 swings between a printing position and a retracted position, and when in the printing position, presses the recording paper 20 on the platen roller 24, and when in the retracted position, comes up away from the platen roller 24.

A head driver 26 is caused by the system controller 18 to control the array 15*b*. While the recording paper 20 is fed in the feeding direction, the system controller 18 drives the heating elements 15*a* at a predetermined temperature according to printing data. The heating elements 15*a* apply heat energy to the recording paper 20 to color the thermosensitive coloring layers selectively. The platen roller 24 is caused to rotate by movement of the recording paper 20 to stabilize the contacted state between the recording paper 20 and the array 15*b*.

In FIG. 2, pad mechanisms 27 are disposed near to the thermal head 15, and push one lateral edge 20*a* of the recording paper 20. A rail or guide member 28 is disposed on the side opposite to the pad mechanisms 27, which press the lateral edge 20*b* of the recording paper 20 against the guide member 28 invariably. The line sensor 14 is disposed upstream from the thermal head 15 and on the side of the lateral edge 20*a*, for detecting the lateral edge 20*a*. The line sensor 14 includes an array 14*b* of plural CCD elements or photo receptor elements 14*a* which are arranged substantially at a pitch of the heating elements 15*a* in the thermal head 15. The line sensor 14 detects the position of the lateral edge 20*a* according to a predetermined sequence while the recording paper 20 is fed. The lateral position data is sent to the system controller 18.

In FIG. 1, the photo interrupter 16 and the fixer 17 are disposed between the feeder rollers 12 and 13. The photo interrupter 16 is constituted by a light projector element 16*a* and a photo receptor element 16*b*. The light projector element 16*a* is disposed under a path of feeding the recording paper 20. The photo receptor element 16*b* is disposed above the feeding path and opposed to the light projector element 16*a*. When the recording paper 20 is fed and comes to a position between the light projector element 16*a* and the photo receptor element 16*b*, light from the light projector element 16*a* is interrupted by the recording paper 20 and does not strike the photo receptor element 16*b*. Upon the interruption of the light, the photo receptor element 16*b* sends a detection signal to the system controller 18.

The fixer 17 includes a yellow fixing ultraviolet lamp 31, a magenta fixing ultraviolet lamp 32 and a reflector 30. The yellow fixing ultraviolet lamp 31 emits near ultraviolet rays with a wavelength peak of 420 nm. The magenta fixing ultraviolet lamp 32 emits near ultraviolet rays with a wavelength peak of 365 nm. A driver 33 is caused by the system controller 18 to energize the fixing ultraviolet lamps 31 and 32, which emit fixing ultraviolet rays to destroy the coloring ability of the yellow and magenta coloring layers after printing.

Figure 3:
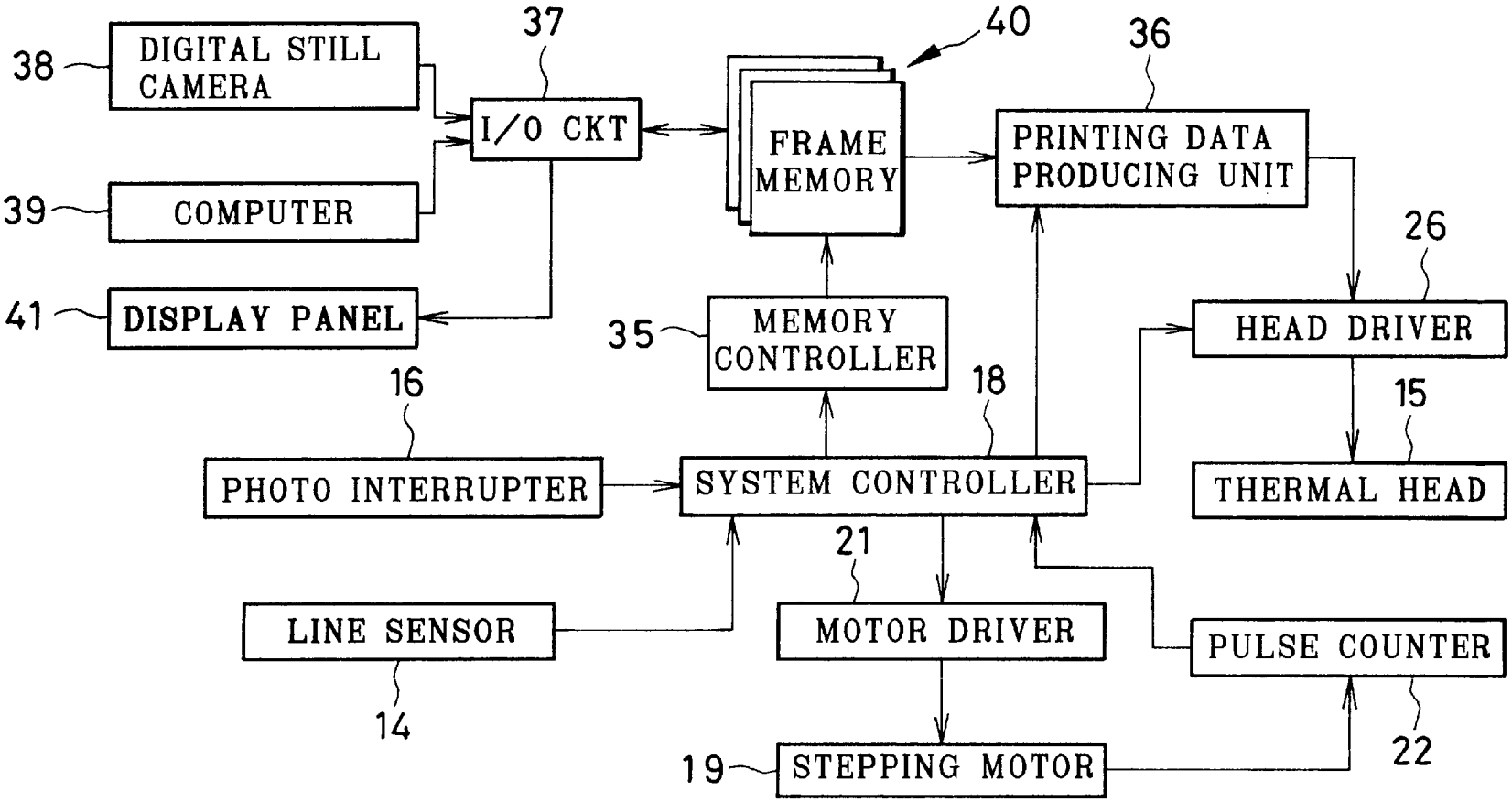
FIG. 3 is a block diagram illustrating the thermal printer.

In FIG. 3, circuit arrangement of the color thermal printer 10 is depicted. Various elements are connected to the system controller 18, including the line sensor 14 and the photo interrupter 16, the motor driver 21 and the head driver 26, and the pulse counter 22, and also a memory controller 35, a printing data producing unit 36 as data correcting unit, and others.

Also, the color thermal printer 10 includes an I/O port (not shown) and an I/O circuit 37. The I/O port is connectable with external devices of various kinds, such as a digital still camera 38, a computer 39 and the like. The I/O circuit 37 is supplied by the digital still camera 38 or the computer 39 at the I/O port with color image data of red, green and blue colors. A frame memory 40 is connected with the I/O circuit 37, through which the input image data is written to the frame memory 40. A video output terminal is included in the I/O port. A display panel 41 such as a CRT displays the simulated print image according to the output from the video output terminal.

In FIG. 2, the system controller 18 identifies locations of effective heating elements 15*c* opposed to the recording paper 20 and remaining heating elements 15*d* offset from the recording paper 20. To be precise, the line sensor 14 detects the lateral edge 20*a* of the recording paper 20 to output data of a position of the lateral edge 20*a*. Among the heating elements 15*a*, the effective heating elements 15*c* are disposed inside the lateral edge 20*a*. The remaining heating elements 15*d* are disposed outside the lateral edge 20*a*.

The color image data stored in the frame memory 40 is read by or written to the printing data producing unit 36 in a suitable manner by the memory controller 35 controlled by the system controller 18. The printing data producing unit 36 produces color drive data of the yellow, magenta and cyan colors to drive the heating elements 15*a* in the thermal head according to the color image data. The drive data is constituted by the non-printing data, the printing data, and the corrected printing data. The non-printing data represents image density of zero (0), is at a level of not generating higher heat energy from the heating elements 15*a* than the bias heat energy, so as not to color the coloring layers. The printing data causes the heating elements 15*a* to generate heat for temperature according to image density. The corrected printing data is produced by processing the image data according to a data correcting process.

The printing data producing unit 36 produces non-printing data for each of the remaining heating elements 15*d* according to the lateral position data detected by the line sensor 14. Also, the printing data producing unit 36 produces printing data for each of the effective heating elements 15*c*. The printing data producing unit 36 produces corrected printing data by subjecting the image data to a data correcting process for the purpose of preventing a drop in the coloring density in relation to effective heating elements 15*c* of a predetermined number in the vicinity of the lateral edges 20*a* and 20*b* of the recording paper 20.

Figure 4:
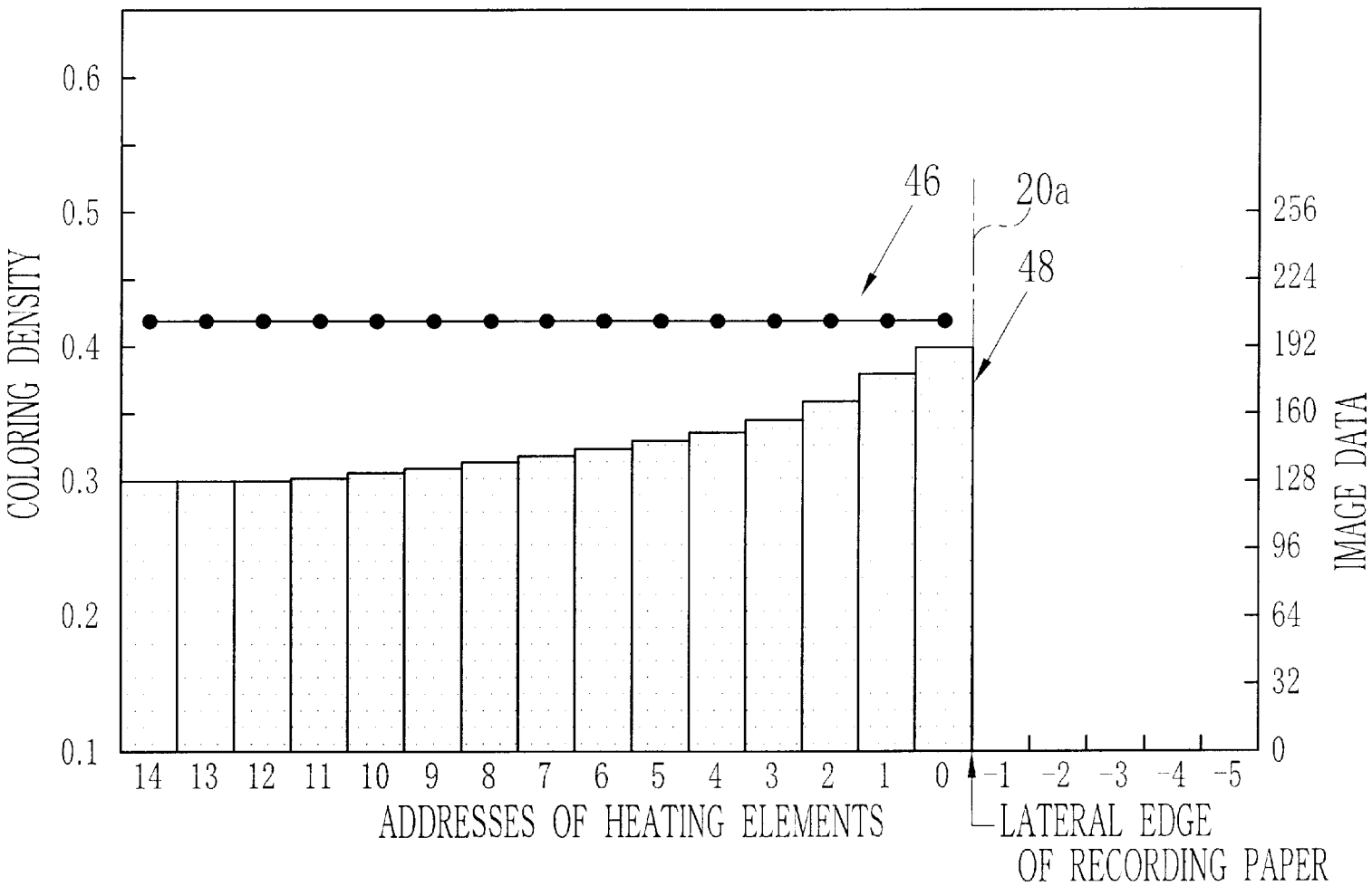
FIG. 4 is a graph illustrating drive data for a thermal head and positions in the recording paper.

For example, let the image data represent an image having density of level 128. In FIG. 4, drive data 48 is depicted. The non-printing data is assigned to the heating elements 15*a* with the addresses –1, –2, . . . , –5 outside the lateral edge 20*a*. For the 12 heating elements 15*a* inside the lateral edge 20*a* at addresses 0–11, corrected printing data is produced in order to increase the heat energy gradually toward the heating element at the address 0. Thus, the gradual increase in the heat energy is effective in keeping the coloring density well conditioned without decreasing toward the lateral edge. Also for the drive data 48 on the side of the lateral edge 20*b*, the same conversion including the correction is effected.

The drive data 48, constituted by the printing data, the corrected printing data and non-printing data, is sent to the head driver 26. See FIG. 3. The head driver 26 is controlled by the system controller 18, drives the heating elements 15*a* in the thermal head 15 according to the drive data 48, to print an image to the coloring layers. The image is printed by utilizing nearly the full width of the recording paper 20. Coloring density 46 is prevented from dropping in the vicinity of the lateral edges 20*a* and 20*b*.

The operation of the above embodiment is described now. To print an image to the recording paper 20 by use of the color thermal printer 10, at first image data is input by the digital still camera 38 or the computer 39. The image data is sent to the I/O circuit 37 and written to the frame memory 40 for each of the colors.

When the color thermal printer 10 is operated to start the printing, the system controller 18 causes the motor driver 21 to rotate the stepping motor 19 in the forward direction. The stepping motor 19 rotates the feeder rollers 11, 12 and 13 in the forward direction, to feed the recording paper 20. During the feeding, the thermal head 15 is kept in the retracted position away from a path of the recording paper 20. The lateral edge 20*b* of the recording paper 20 is pressed against the guide member 28 by the pad mechanisms 27 while the recording paper 20 is fed.

The line sensor 14 detects the position of the lateral edge 20*a* of the recording paper 20, and sends lateral edge position data to the system controller 18. In response to this, the system controller 18 designates the effective heating elements 15*c* opposed to the recording paper 20 and the remaining heating elements 15*d* not opposed to the recording paper 20. When a front edge of the recording paper 20 is detected by the photo interrupter 16, the thermal head 15 is set in a printing position, to start the thermal recording of the yellow color.

The printing data producing unit 36 receives color image data from the frame memory 40, and produces the yellow printing data, the yellow corrected printing data and the yellow non-printing data. The yellow printing data causes application of heat to the effective heating elements 15*c* up to a predetermined temperature. The yellow corrected printing data is produced to prevent a drop in the coloring density in the vicinity of the lateral edges 20*a* and 20*b* of the recording paper 20. The yellow non-printing data is produced in order to generate the bias heat energy that is slightly short of energy for developing the color. The yellow drive data including those data is sent to the head driver 26.

The head driver 26 drives the heating elements 15*a* according to the yellow drive data, to develop color of the yellow coloring layer at intended density. When printing of one line is completed, the recording paper 20 is fed by one line, before printing another line similarly. Feeding of the recording paper 20 is repeated until the yellow image finishes being printed. When a portion of the yellow image comes to the fixer 17, the yellow coloring layer is fixed optically by the yellow fixing ultraviolet lamp 31 controlled by the system controller 18.

When the fixation of the yellow coloring layer is completed, the feeder rollers 11, 12 and 13 are rotated in the backward direction, to return the recording paper 20 to the position of starting magenta recording. At the same time as the yellow recording, the printing data producing unit 36 subjects the magenta image data to correction according to the edge position data, produces the drive data including the magenta corrected printing data. The magenta drive data is sent to the head driver 26.

The head driver 26 drives the heating elements 15*a* in synchronism with feeding of the recording paper 20 according to the magenta drive data being input. A magenta image is recorded to the magenta coloring layer. When a portion of the magenta image comes to the fixer 17, the magenta coloring layer is fixed optically by the magenta fixing ultraviolet lamp 32 controlled by the system controller 18.

Upon completion of the magenta fixation, the feeder rollers 11, 12 and 13 are rotated in the backward direction again, to return the recording paper 20 to the position of starting cyan recording. At the same time as the yellow recording, the printing data producing unit 36 subjects the cyan image data to correction according to the edge position data, produces the drive data including the cyan corrected printing data. The cyan drive data is sent to the head driver 26.

The head driver 26 drives the heating elements 15*a* in synchronism with feeding of the recording paper 20 according to the cyan drive data being input. A cyan image is recorded to the cyan coloring layer in a manner similar to the magenta recording. Note that the cyan coloring layer does not have optical fixability, because the heat sensitivity of the cyan coloring layer is very low to such an extent that the cyan coloring layer does not develop color in an ordinary preserved state. However, the magenta fixing ultraviolet lamp 32 is driven during the cyan recording in a similar manner as the magenta recording. An unrecorded region is bleached to remove an yellowish appearance.

After completion of the thermal recording and fixation to all the coloring layers, the recording paper 20 is still fed. A cutting position for each one print frame comes to a cutter (not shown). The cutter is actuated to cut the recording paper 20 by each frame. As the recording paper 20 is squeezed and fed by the feeder rollers 11, 12 and 13, a margin is likely to occur on a front or rear edge of the print frame. In consideration of this, the system controller 18 determines cutting positions at each of front and rear edges to position the recording paper 20 with respect to the cutter. So the cutter cuts the front and rear margins away. Finally, a print without margins on the periphery is obtained. The print frame is exited to the outside of the printer.

If one lateral edge of the recording paper 20 is not exactly positioned at an end of a particular one of the heating elements 15*a*, the lateral edge lies to intersect the particular heating element 15*a*. It has been found experimentally that, if the particular heating element 15*a* crossed by the lateral edge is driven according to corrected printing data, a dot of extremely high density is printed at the lateral edge, to create a streak of black color. Reasons for this are assumed as follows. The lateral edge has been produced by cutting in the course of manufacture. Three color thermosensitive coloring layers emerge in an end face of the lateral edge, and thus have considerably higher heat sensitivity than they have in other portions. Also, a portion of the recording paper 20 with the lateral edge has a curled form, ans thus is likely to press the heating elements 15*a* more strongly. The black streak is created by coloring of the three coloring layers at high density.

Figure 5:
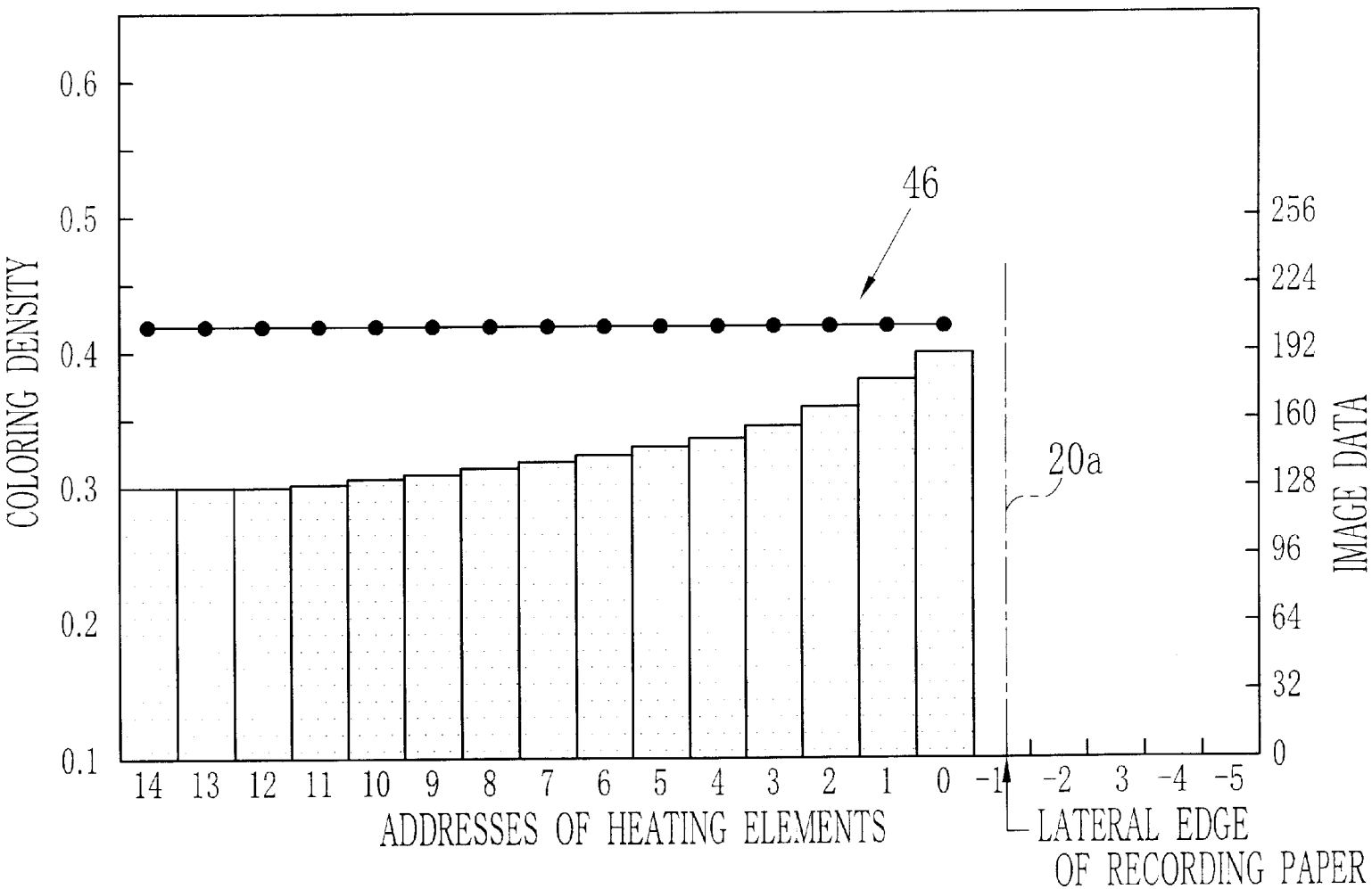
FIG. 5 is a graph illustrating another preferred drive data in which printing data increases toward a lateral edge.

In the embodiment of FIG. 5, the lateral edge 20*a* of the recording paper 20 is positioned to intersect one of the heating elements 15*a* having an address of −1. Non-printing data is supplied to the heating element 15*a* at the address of −1, to suppress occurrence of black streak along the lateral edge 20*a*. To the effective heating elements 15*c* having addresses of 0–11, corrected printing data is supplied, of which a heat energy level gradually increases toward the address 0.

Figure 6:
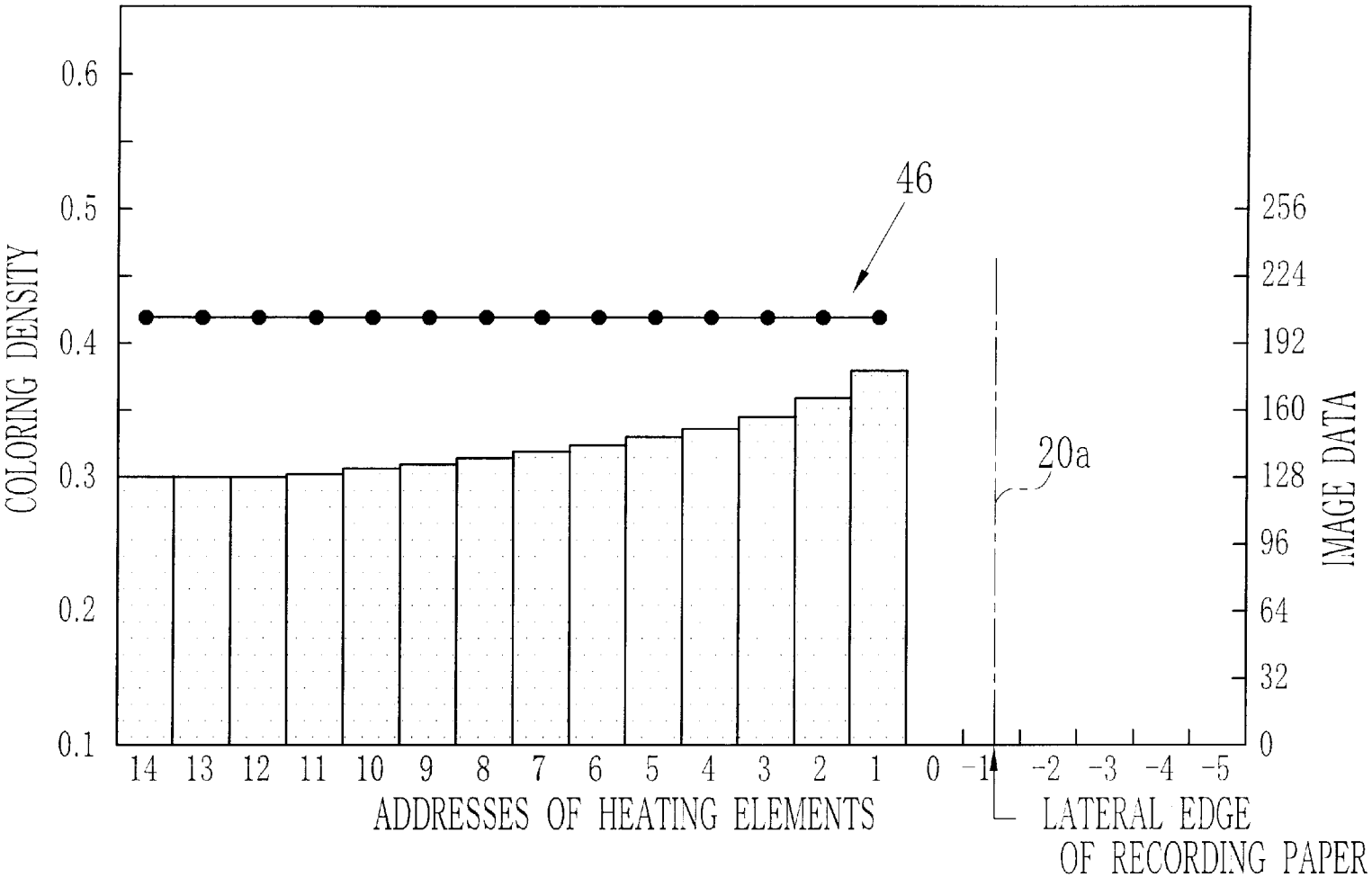
FIG. 6 is a graph illustrating still another preferred drive data.

In the course of manufacture, the recording paper 20 is obtained by cutting at a regular width. Even though the recording paper 20 is produced in a common process, positions of the lateral edges 20*a* and 20*b* change minutely within the single strip of paper. Note that a width of each of the heating elements 15*a* is approximately 120–150 $\mu$m. The position of the lateral edge 20*a* changes even during a printing process of one sheet. Thus, drive data according to FIG. 6 is preferably used. To suppress occurrence of a black streak along the lateral edge 20*a*, non-printing data is supplied to the one of the effective heating elements 15*c* at the address 0. Although the entirety of the heating element 15*c* at the address 0 is located inside the lateral edge 20*a*, non-printing data is supplied to the same for the purpose of reliability in preventing a black streak from occurrence.

In the present embodiment, the non-printing data is supplied to only one of the effective heating elements 15*c*. Note that the number of heating elements to be supplied with the non-printing data may be two, three or more. Let N be the number of heating elements among the effective heating elements 15*c* positioned in a region relatively near to the lateral edge 20*a*. Let M be the number of heating elements among the effective heating elements 15*c* positioned very adjacent to the lateral edge 20*a*. Then the numbers N and M satisfy the condition N>M. In the embodiment of FIG. 6, N=12 at the addresses 0–11 in the effective heating elements 15*c*, and M=1 at the address 0.

In the embodiments of FIGS. 4, 5 and 6, the image data is replaced by the drive data 48 that is incremental toward the lateral edges 20*a* and 20*b* of the recording paper 20. For this correcting process, a train of pixel density additional data can be predetermined as a finite sequence of numbers increasing toward the lateral edges 20*a* and 20*b*. The pixel density additional data may be added to the image data by each of the effective heating elements 15*c*. Also, a train of pixel density weight data can be predetermined as a finite sequence of factors increasing toward the lateral edges 20*a* and 20*b*. The pixel density weight data may be multiplied by the image data by each of the effective heating elements 15*c*.

Figure 7:
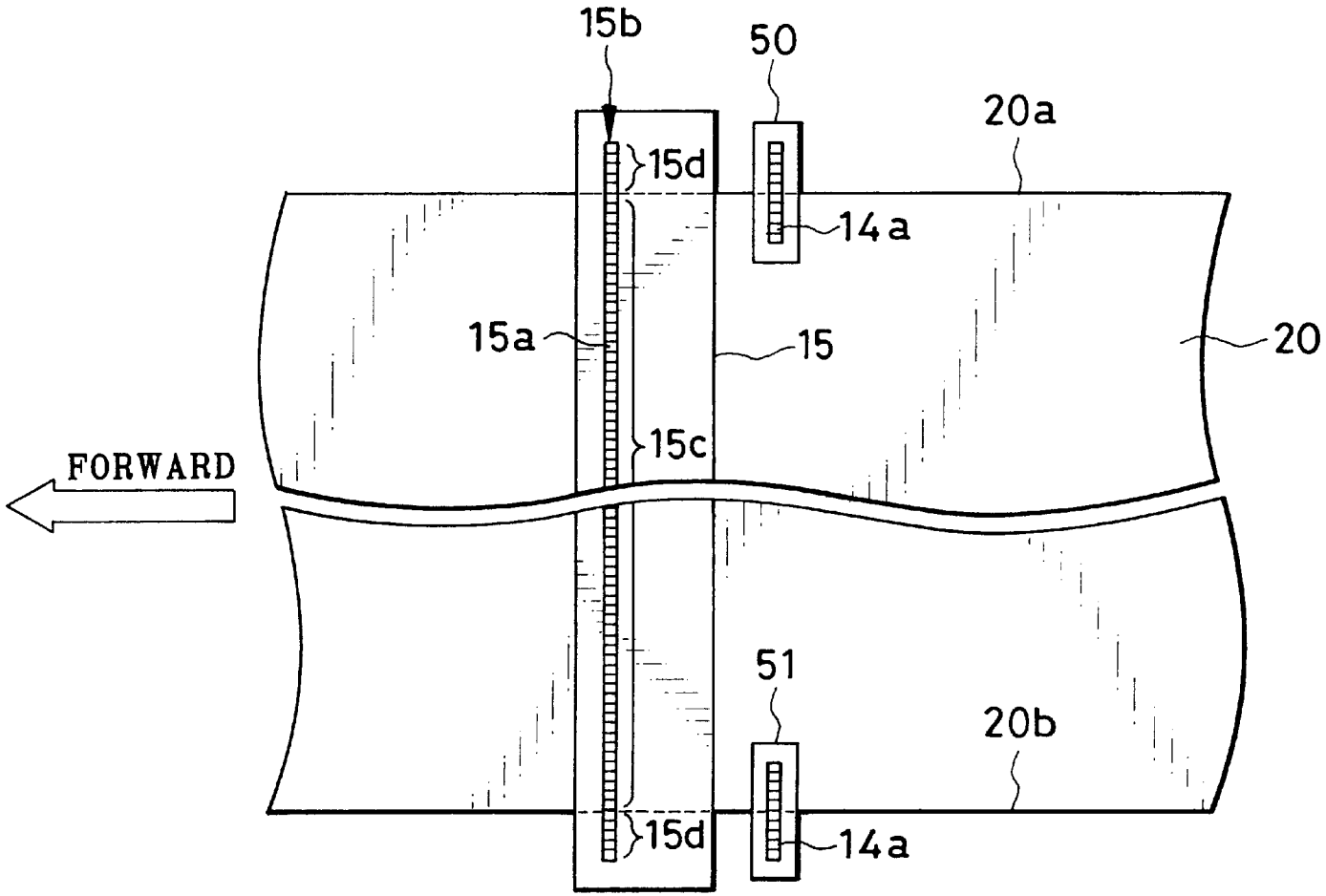
FIG. 7 is a plan, partially cutaway, illustrating another preferred embodiment having two line sensors.

In the above embodiments, the lateral edge 20*b* of the recording paper 20 is pressed against the guide member 28 by pushing the lateral edge 20*a* with the pad mechanisms 27. The lateral edge 20*a* is detected by the line sensor 14 so as to correct the image data. In FIG. 7, another preferred embodiment is depicted, in which line sensors 50 and 51 as position determining unit are disposed to extend across respectively the lateral edges 20*a* and 20*b*, detect the lateral edges 20*a* and 20*b* to generate two sets of lateral position data. The image data can be subjected to correcting process.

Figure 8:
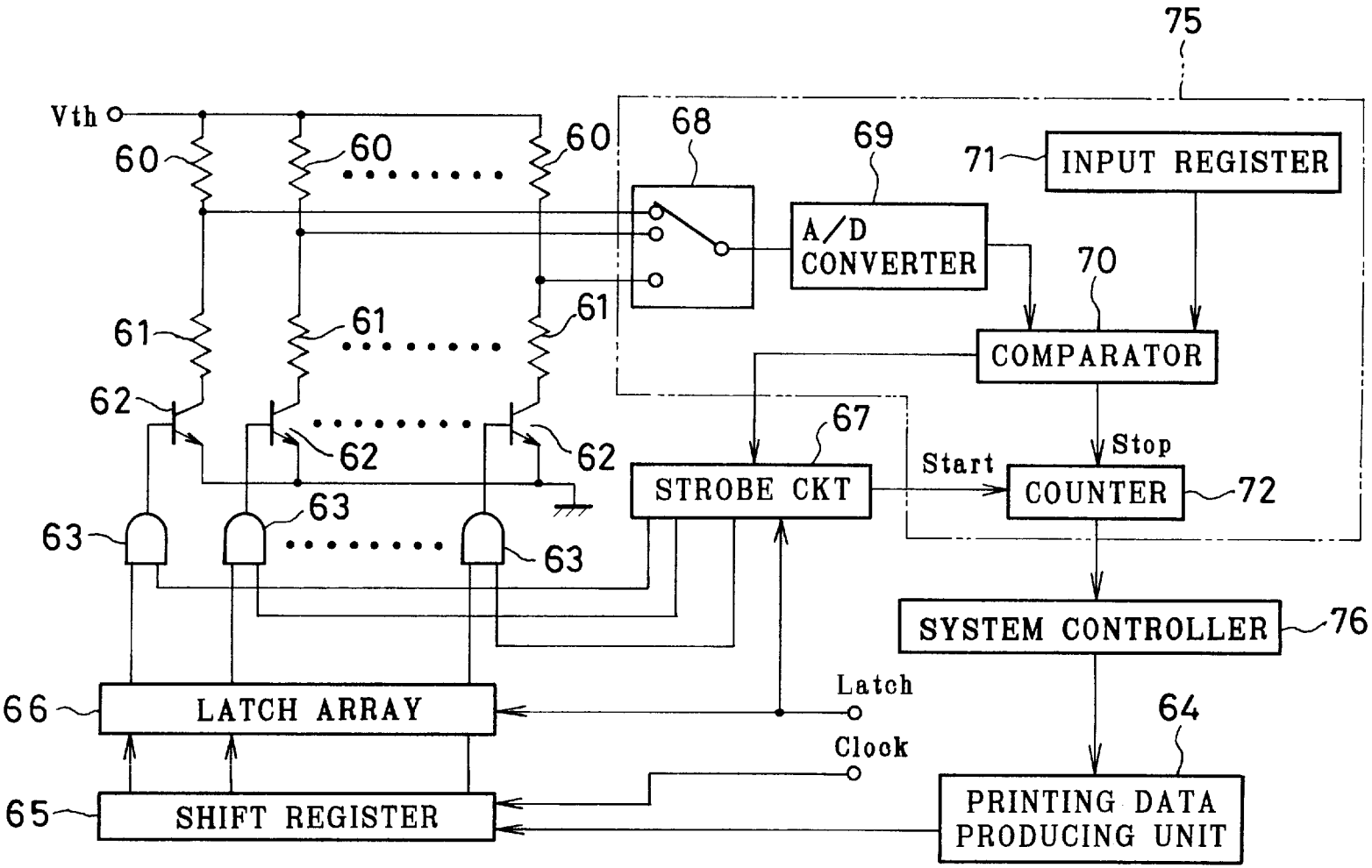
FIG. 8 is a block diagram illustrating still another preferred embodiment in which a temperature measurer is connected with the heating elements so as to detect lateral edges of the recording paper.

Instead of using the line sensor 14 or the line sensors 50 and 51, the energization time or heating time for the heating elements may be evaluated, for the purpose of detecting the lateral edge positions. In FIG. 8, a color thermal printer of another preferred embodiment is depicted.

Measurement resistors 61, transistors 62 and AND gates 63 are connected with heating elements 60. A head voltage Vth of a predetermined level is applied to the heating elements 60. A printing data producing unit 64 produces printing data of a serial signal, which is input to a shift register 65 in synchronism with a clock signal. The shift register 65 converts the printing data to a parallel signal, and sends the parallel signal to a latch array 66. The latch array 66 is caused to latch the printing data in synchronism with the latch signal. Also, a strobe circuit 67 receives the latch signal, and responsively sends a strobe signal of the H level to one input terminal of the AND gates 63. The strobe signal has a driving pulse width which is changed between the colors to be recorded. When the second input terminal of the AND gates 63 is set at the H level by the output of the latch array 66, then the output terminal of the AND gates 63 becomes the H level to render the transistors 62 conductive. The heating elements 60 are energized to generate heat.

An A/D converter 69 is connected to a connection point between the heating elements 60 and the measurement resistors 61 via a selector 68. The heating elements 60 have such a characteristic that their resistance depends on the temperature. The temperature of the heating elements 60 is detected according to changes in the voltage due to changes in the resistance. The heating elements 60 have such a characteristic that their resistance decreases in response to rise in the temperature. The connection voltage at the connection point decreases when the temperature of the heating elements 60 becomes high. A signal of the voltage of the connection point is sent to the A/D converter 69, and converted by the same into a digital signal, which is input to the comparator 70. An input register 71 as memory stores a target voltage value EO obtained by conversion of a target temperature of the heating elements 60 in a voltage value. The comparator 70 compares the voltage E with the target voltage E0, and if $E<E0$, outputs a comparison signal at the L level, and if $E \geqq E0$, then outputs a comparison signal at the H level. The comparison signal is sent to a counter 72 and the strobe circuit 67. In short, a temperature measurer 75 or voltage measuring circuit for the heating elements is constituted by the measurement resistors 61, the selector 68, the A/D converter 69, the comparator 70, the input register 71 and the like.

The strobe circuit 67 turns on the heating elements 60 to be driven, and at the same time, sends a start signal to the counter 72. The counter 72 counts the clock signal to measure the heating time. The counter 72 completes the measuring of time upon receiving a stop signal from the comparator 70. The selector 68 is changed over to measure each one of the heating elements 60. A system controller 76 as position determining unit is supplied with data of the heating time of the heating elements 60. The system controller 76 calculates and determines positions of the lateral edges 20*a* and 20*b* of the recording paper 20 according to differences in the heating time between the heating elements 60. In general, part of the heating elements 60 contacting the recording paper 20 requires longer heating time before reaching one given temperature than part of the heating elements 60 without contacting the recording paper 20, because heat quickly dissipates specifically from the heating elements 60 in contact with the recording paper 20. The positions of the lateral edges 20*a* and 20*b* can be determined according to the difference in the heating time.

The detection of the lateral edges 20*a* and 20*b* is effected before starting printing. Before printing the first line, one dummy printing line is set. Dummy printing data is set to the shift register 65 at a level short of coloring the yellow coloring layer. Heating time of the heating elements 60 elapsed until the reach to a predetermined temperature is obtained by each of the heating elements. A borderline where values of the heating time are distinctly different between the heating elements can be obtained, and determined as the lateral edge 20*a* or 20*b* of the recording paper 20. Note that, during the operation of detecting the lateral edges 20*a* and 20*b*, the strobe circuit 67 sends the strobe signal to each of the AND gates 63 at the H level so as to drive the heating elements 60 by one element for the purpose of dummy printing. The heating time of the heating elements 60 until the reach to the predetermined temperature can be obtained sequentially by each one of the heating elements.

The lateral edge position data is input to the printing data producing unit 64. According to this, the data for first and succeeding lines is subjected to the correcting process in a manner similar to that of the above embodiment.

In the above embodiment, the dummy printing line is preset to detect the lateral edges 20*a* and 20*b* by heating the recording paper 20 at the temperature insufficient for yellow recording. However, a first printing line as a part of an image may be utilized instead of the dummy printing line for the purpose of evaluating the differences in the heating time to detect the edge positions.

In the above embodiments, the thermosensitive recording paper of a continuous form is used. Also, thermosensitive recording sheets of a limited size may be used. In the above embodiments, the recording paper has the three coloring layers of the yellow, magenta and cyan. However, recording paper may have four coloring layers additionally having a black coloring layer.

The full-color thermal recording of the above embodiment is a one-head three-pass type. However, the full-color thermal recording of the above embodiment may be a three-head one-pass type in which three thermal heads are used for recording respectively the yellow, magenta and cyan colors, and the recording paper is fed at one time for the full-color printing.

In the above embodiments, the recording paper 20 is a roll paper and having the fixed width. However, it is possible to use the recording paper 20 having a width different from the fixed width. In this case, the lateral edge position detected by the sensor is evaluated to determine a width allowable for printing an image. Image data for portions in the vicinity of the lateral edge position can be subjected to the correcting process. An image can be thermally recorded after a processing operation of the image data for enlargement or reduction according to a factor derived from the allowable width for printing.

In the above embodiments, prints are thermally recorded without margins in both of the lateral edges. However, it is possible in the present invention to print an image without a margin along a first lateral edge, and with a margin along a second lateral edge. In the vicinity of the first lateral edge, the correcting process of the present invention is used so as to print an image thermally with agreeably sufficient density. An edge portion with insufficient density is printed along the second lateral edge portion, but can be cut away with the margin.

In general, the heating elements respectively record one dot when driven by bias driving and image driving. The bias driving causes generating of heat energy that is slightly short of development of color. The image driving generates image heat energy at a level according to coloring density to be recorded. In the present invention, the above-described non-printing data may be data only for the bias driving, and also may be data of suppressing operation of the heating elements without any bias driving.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer having a thermal head including plural heating elements, wherein said heating elements are arranged in an array in a main scan direction, are driven according to respectively image data, for recording an image by one line to recording material moved in a sub scan direction, said heating element array having a size greater in said main scan direction than said recording material, said thermal printer comprising:

a position determining unit for detecting at least one lateral edge of said recording material, to determine effective heating elements in contact with said recording material among said heating elements; and a data correcting unit for effecting a correcting process to part of said image data for heating elements of a first group included in said effective heating elements, wherein said first group of said heating elements contacts said at least one lateral edge and a near portion near to said at least one lateral edge in said recording material.

2. A thermal printer as defined in claim 1, wherein ineffective heating elements included in said heating elements but offset from said recording material are supplied with non-printing data by way of said image data, and are kept from causing development of color.

3. A thermal printer as defined in claim 2, wherein said data correcting unit corrects said image data by adding predetermined additional data thereto, said additional data increasing in a heat energy level toward said lateral edge between said heating elements in said first group.

4. A thermal printer as defined in claim 2, wherein said first group includes:

P heating elements, including a first heating element in a middle of which said at least one lateral edge is positioned;

Q heating elements disposed adjacent to a train of said P heating elements;

wherein said data correcting unit substitutes non-printing data for part of said image data for said P heating elements;

said data correcting unit further corrects part of said image data for said Q heating elements by adding predetermined additional data thereto, said additional data increasing in a heat energy level toward said lateral edge between said Q heating elements.

5. A thermal printer as defined in claim 4, wherein P=1.

6. A thermal printer as defined in claim 2, wherein said position determining unit has plural photo receptor elements arranged in an array in said main scan direction and at a pitch that is substantially a pitch of said plural heating elements.

7. A thermal printer as defined in claim 6, further comprising:

a guide member for guiding a first lateral edge of said recording material in said sub scan direction;

a pad mechanism for pushing a second lateral edge of said recording material in said main scan direction, to press said first lateral edge against said guide member;

wherein said position determining unit detects said second lateral edge.

8. A thermal printer as defined in claim 6, wherein said position determining unit includes first and second arrays of photo receptor elements, disposed to extend in said main scan direction, for detecting respectively said first and second lateral edges of said recording material.

9. A thermal printer as defined in claim 2, wherein said position determining unit further comprises:

a temperature measurer for measuring temperature of respectively said heating elements;

a heating time measurer for measuring heating time elapsed while said temperature rises to a predetermined temperature; and a determiner for comparing said heating time between said heating elements, and for determining that heating elements of which said heating time is longer are said effective heating elements.

10. A thermal printer as defined in claim 9, wherein said temperature measurer includes:

a measurement resistor connected with said heating elements;

a voltage detector for detecting a connection voltage of a connection point between said heating elements and said measurement resistor;

said heating time measurer includes:

a comparator for comparing said connection voltage with a reference voltage; and a counter for being started counting in response to driving of said heating elements, and for being stopped from counting in response to an output of said comparator upon coming of said connection voltage down to said reference voltage.

11. A thermal printing method in which a thermal head is used, said thermal head including plural heating elements, arranged in an array in a main scan direction, driven according to respectively image data, for recording an image by one line to recording material moved in a sub scan direction, said heating element array having a size greater in said main scan direction than said recording material, said thermal printer comprising:

detecting at least one lateral edge of said recording material, to determine effective heating elements in contact with said recording material among said heating elements; and effecting a correcting process to part of said image data for heating elements of a first group included in said effective heating elements, wherein said first group of said heating elements contacts said at least one lateral edge and a near portion near to said at least one lateral edge in said recording material.

12. A thermal printing method as defined in claim 11, wherein ineffective heating elements included in said heating elements but offset from said recording material are supplied with non-printing data by way of said image data, and are kept from causing development of color.

13. A thermal printing method as defined in claim 12, wherein said correcting step corrects said image data by adding predetermined additional data thereto, said additional data increasing in a heat energy level toward said lateral edge between said heating elements in said first group.

14. A thermal printing method as defined in claim 12, wherein said first group includes:

P heating elements, including a first heating element in a middle of which said at least one lateral edge is positioned;

Q heating elements disposed adjacent to a train of said P heating elements;

wherein said correcting step substitutes non-printing data for part of said image data for said P heating elements;

said correcting step further corrects part of said image data for said Q heating elements by adding predetermined additional data thereto, said additional data increasing in a heat energy level toward said lateral edge between said Q heating elements.

* * * * *